US005445072A

United States Patent [19]

Yagi et al.

[11] Patent Number: 5,445,072

[45] Date of Patent: Aug. 29, 1995

[54] APPARATUS FOR ADJUSTING B.D.C. POSITION OF SLIDE IN MECHANICAL PRESS

[75] Inventors: Takashi Yagi; Mitsuo Sato, both of Sagamihara, Japan

[73] Assignee: Aida Engineering Ltd., Kanagawa, Japan

[21] Appl. No.: 304,445

[22] Filed: Sep. 12, 1994

[30] Foreign Application Priority Data

Dec. 27, 1993 [JP] Japan ..... 5-331347

[51] Int. Cl.[6] ..... B30B 15/14

[52] U.S. Cl. ..... 100/48; 100/53; 100/99; 100/257; 72/446

[58] Field of Search ..... 72/441, 446, 453.13, 72/453.14; 83/527; 100/43, 48, 53, 99, 257, 282

[56] References Cited

U.S. PATENT DOCUMENTS

| | | | |
|---|---|---|---|
| 3,005,404 | 10/1961 | Tucker | 100/257 |
| 4,011,809 | 3/1977 | Waller | 100/257 |
| 4,166,415 | 9/1979 | Spanke | 100/257 |
| 4,823,687 | 4/1989 | Yonezawa | 100/257 |

FOREIGN PATENT DOCUMENTS

| | | |
|---|---|---|
| 226672 | 7/1987 | European Pat. Off. . |
| 2350950 | 12/1977 | France . |
| 2424783 | 3/1976 | Germany . |
| 1-30569 | 6/1989 | Japan . |
| 1545392 | 5/1979 | United Kingdom . |

OTHER PUBLICATIONS

Patent Abstracts of Japan, vol. 13, No. 130 (M-808) (3478) Mar. 30, 1989 and JP-A-63 299 900 (Amada Co Ltd) Dec. 7, 1988.

Patent Abstracts of Japan, vol. 8, No. 263 (M-342) (1700) Dec. 04, 1984 and JP-A-59 137 133 (Komatsu Seisakusho K.K.) Aug. 07, 1984.

*Primary Examiner*—David A. Scherbel
*Assistant Examiner*—Terrence R. Till
*Attorney, Agent, or Firm*—Lowe, Price, Leblanc & Becker

[57] ABSTRACT

An apparatus for adjusting bottom-dead-center position of a slide in mechanical press including a connecting rod 4 connected to a crank shaft 3, and a hydraulic cylinder 15 provided between the connecting rod 4 and a slide 5. The hydraulic cylinder 15 has a piston rod 16 having one end connected to the connecting rod 4, a cylinder body 17 capable of moving relative to the piston rod 16, a hydraulic chamber 27 formed below a piston portion 16A, and a pressure adjusting means 45 connected to this hydraulic chamber 27. An extending member 19 for connecting the connecting rod and the cylinder body is fitted around an outer periphery of the piston rod 16, and the adjustment of the bottom-dead-center position of the slide can be effected as the extending member 19 is extended by the adjustment of hydraulic pressure within the hydraulic chamber 27.

3 Claims, 5 Drawing Sheets

APPARATUS FOR ADJUSTING B.D.C. POSITION OF SLIDE IN MECHANICAL PRESS

BACKGROUND OF THE, INVENTION

1. Field of the Invention

The present invention relates to an apparatus for adjusting B.D.C.position (bottom-dead-center position) of a slide in an apparatus for a mechanical press.

2. Description of the Related Art

In cases where a material is punched with a punch and a die, it is necessary to effect punching by maintaining an accurate bottom-dead-center position of a slide so as to prolong the life of the punch and the die. In cases where coining is effected in which a material is compressed by the punch and the die, or scoring is effected in which the material is marked with notches and incisions, an additional load due to the contacting of the slide against a stopper block occurs in a mechanical press in addition to a working load. Because of this, it is conducted to accurately control the penetration of the punch into the material and the thickness of a remaining portion of the material when the slide which has approached a bolster is brought into contact with the stopper block. When a press operation is started, the temperatures of members such as connecting rods which connect a crank shaft and the slide increase due to the motion, and such members undergo thermal expansion. Since the temperature rise is not uniform depending on the members, in the case of punching, the bottom-dead-center position of the slide is offset downward from an accurate position. Also, in the cases of coining and scoring, the additional load due to the stopper block increases, so that a large press load is generated during press working.

To overcome the above problem, a method in which temperature-controlled oil is applied to the connecting rods (Japanese Patent Application Publication No. 30569/1989), and the use of an adjusting screw mechanism for adjusting the die height are conventionally known.

With the conventional technique in which temperature-controlled oil is applied to the connecting rods, an apparatus for adjusting the oil temperature is required. It is very difficult to adjust the length of the connecting rods accurately by the temperature-controlled oil, thereby making it virtually difficult to obtain a predetermined bottom-dead-center position of the slide. With the conventional technique using the die-height adjusting screw mechanism, an adjustment screw for eliminating the looseness of the adjusting screw during a press operation must be locked with a lock nut, and during the die height adjustment, the die height adjustment must be made after the lock of the lock nut is released, and then the lock must be provided again by means of the lock nut. In the case of this die-height adjusting screw mechanism, if this die-height adjusting operation is carried out during the press operation, the bottom-dead-center position of the slide changes substantially due to the looseness of the adjusting screw while the lock is being released. As such, with the conventional techniques, the means for correcting the bottom-dead-center position of the slide, which changes due to the thermal expansion of the connecting rods and the like during a press operation, have not necessarily been effective.

SUMMARY OF THE INVENTION

Accordingly, an object of the present invention is to provide an apparatus for adjusting bottom-dead-center position of a slide in mechanical press which makes it possible to effect the operation of adjusting the bottom-dead-center position of the slide not only when the press is being stopped but also when the press is being operated, and which is capable of maintaining the accuracy of the bottom-dead-center position.

To attain the above object, in accordance with the present invention, there is provided an apparatus for adjusting bottom-dead-center position of a slide in mechanical press including a connecting rod connected to a crank shaft, and a slide connected to the connecting rod by means of a hydraulic cylinder, wherein: the hydraulic cylinder has a piston rod one end of which is connected to the connecting rod by means of a plunger, a cylinder body connected to the slide and provided in such a manner as to be movable relative to the piston rod, and a hydraulic chamber provided below the piston rod, pressure oil adjusted by means of a pressure adjusting means capable of being supplied to and discharged from the hydraulic chamber; and an extending member having one end connected to the connecting rod and another end connected to the cylinder body is fitted around an outer periphery of the piston rod, the extending member being provided in such a manner as to be capable of being extended by the adjustment of hydraulic pressure within the hydraulic chamber.

If the hydraulic pressure within the hydraulic chamber in the cylinder body is raised by the pressure adjusting means when the press is being stopped, a pressing load acts on the cylinder body. This pressing load is transmitted to the hollow cylindrical extending member fitted around the outer periphery of the piston rod, so that the extending member undergoes a displacement by being extended. As a result, the bottom-dead-center position of the slide is lowered. This position is an initial targeted bottom-dead-center position, and the press operation is subsequently started. When the connecting rods and the like have undergone thermal expansion during this press operation, and the bottom-dead-center position of the slide has been lowered, the hydraulic pressure within the hydraulic chamber is lowered to reduce the pressing load acting on the extending member and reduce the amount of extension of the extending member, thereby raising the bottom-deadcenter position of the slide and maintaining the same at a fixed position at all times. Consequently, the press load does not change.

DETAILED DESCRIPTION OF THE PREFERRED EMBODIMENT

Referring now to the accompanying drawings, a detailed description will be given of an embodiment of the present invention.

Figure 1:
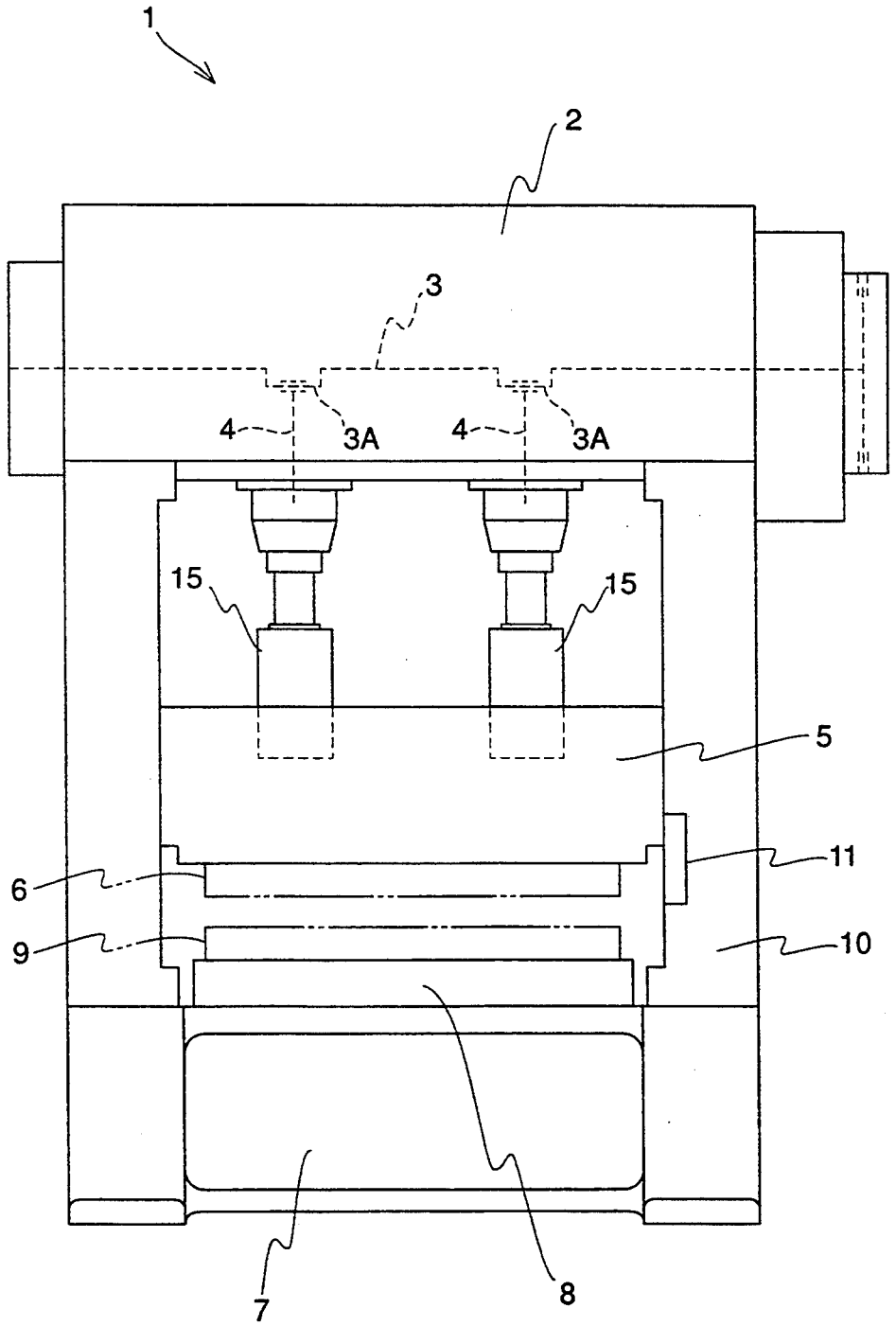
FIG. 1 is a front elevational view of a mechanical press to which the apparatus in accordance with an embodiment of present invention is applied.
Figure 2:
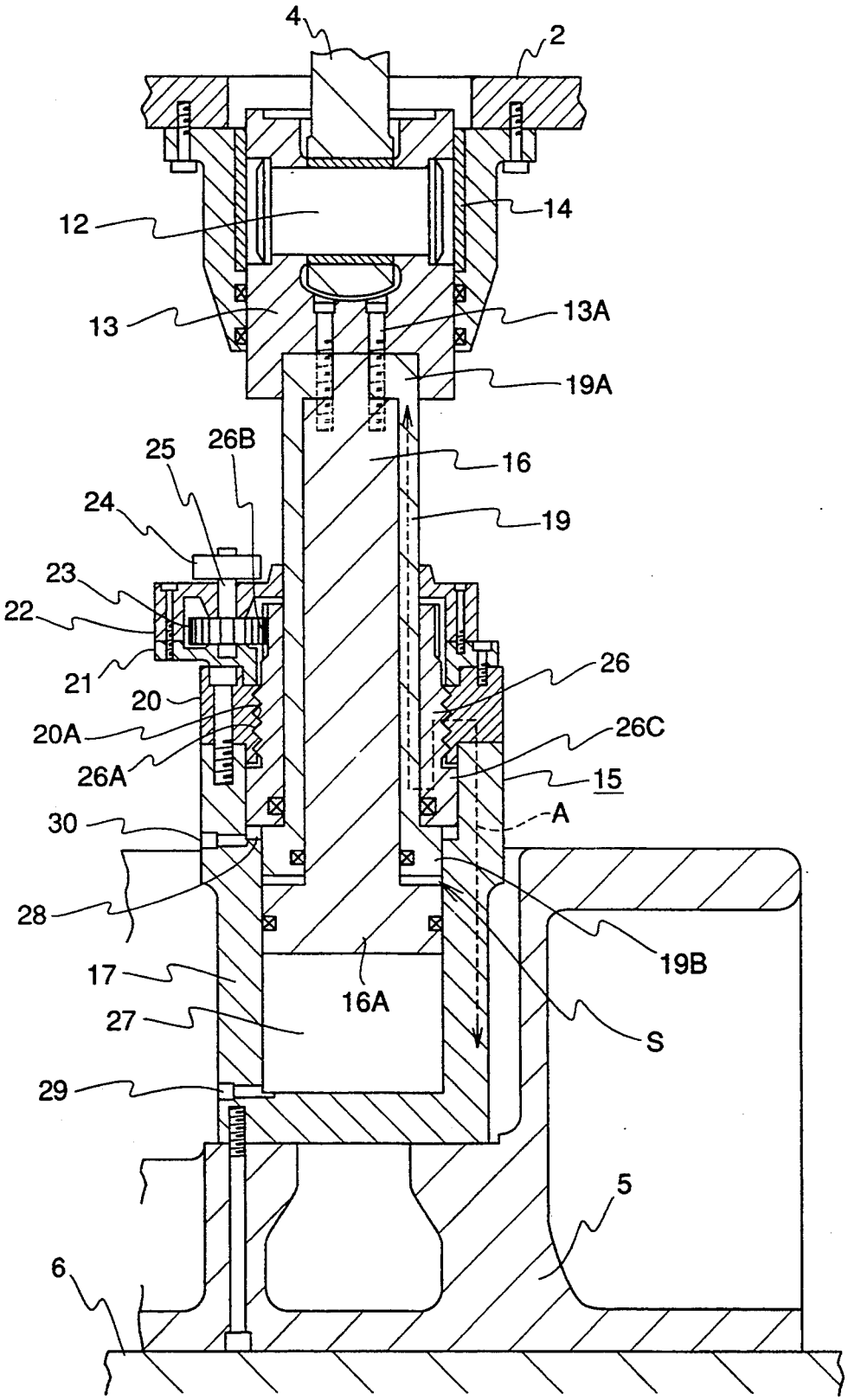
FIG. 2 is a cross-sectional view illustrating essential portions of FIG. 1.

FIG. 1 shows a mechanical press 1 to which the present invention is applied. A crank shaft 3 is disposed inside a crown 2 such that as a flywheel is rotated by power from an unillustrated motor, the crank shaft 3 is rotated thereby via a clutch. An upper end of a connecting rod 4 is connected to each of a pair of eccentric portions 3A of the crank shaft 3. A slide 5 is connected to a lower end of each connecting rod 4 by means of an apparatus in accordance with this embodiment which is shown in FIG. 2, and the slide 5 moves vertically as the crank shaft 3 rotates. An upper die 6 is attached to the slide 5, and a lower die 9 is attached to a bolster 8 on a bed 7.

As shown in FIG. 1, a pair of columns 10 are provided with a bottom-dead-center position detecting means 11 for detecting the bottom-dead-center position of the slide 5.

In FIG. 2, a plunger 13 is connected to the lower end of the connecting rod 4 by means of a pin 12, and the plunger 13 moves vertically while being guided by a guide member 14 fixed to the crown 2. A piston rod 16 is connected to the plunger 13 by means of bolts 13A, and a cylinder body 17 of each hydraulic cylinder 15 is connected to the slide 5.

A hollow cylindrical extending member 19 is fitted over an outer periphery of the piston rod 16, and an upper end 19A of the extending member 19 is connected to the piston rod 16 and the plunger 13 by means of the bolt 13A. An inner peripheral surface of the extending member 19 is slidable with respect to an outer peripheral surface of the piston rod 16. A flange 19B at a lower end of the extending member 19 is spaced apart by a gap S upwardly from a piston portion 16A at a lower end of the piston rod 16.

An internally threaded member 20 is fixed to an upper surface of the cylinder body 17. First and second cap members 21 and 22 are further attached on top of it. A pinion 23 is accommodated in a space formed by these first and second members 21 and 22. The pinion 23 is rotated by means of a shaft 25 as a rotating member 24 above the second cap member Is rotated manually or by a driving means such as a motor.

An externally threaded member 26 is rotatably fitted around an outer periphery of the extending member 19, and an external thread portion 26A of the externally threaded member 26 meshes with an internal thread portion 20A of the internally threaded member 20. A toothed portion 26B meshing with the pinion 23 is formed in an upper portion of the externally threaded member 26, so that if the pinion 23 rotates, the externally threaded member 26 also rotates. A flange 26C is formed at a lower end of the externally threaded member 26, and this flange 26C and the lower-end flange 19B of the extending member 19 abut against each other in the state shown in FIG. 2.

In the arrangement, in a case where the vertical load has acted on the cylinder body 17 of each hydraulic cylinder 15 due to the rising of pressure within tile hydraulic chamber, this load is transmitted to the extending member 19 by means of the internally threaded member 20 and the externally threaded member 26, as indicated by the dotted line A in FIG. 2. In other words, the extending member 19 is in a state in which it is connected to the cylinder body 17 in the axial direction of the hydraulic cylinder 15, so that the extending member 19 undergoes a displacement by being extended by the portion of a length corresponding to the modulus of elasticity of the extending member 19 due to the load acting on the cylinder body 17. At this time, the position of the bottom dead center of the slide 5 changes due to the displacement by extension of the extending member 19. The amount of this change in the bottom-dead-center position of the slide is determined on the basis of the magnitude of the load acting on the piston portion 16A and the modulus of elasticity of the extending member 19.

Figure 3:
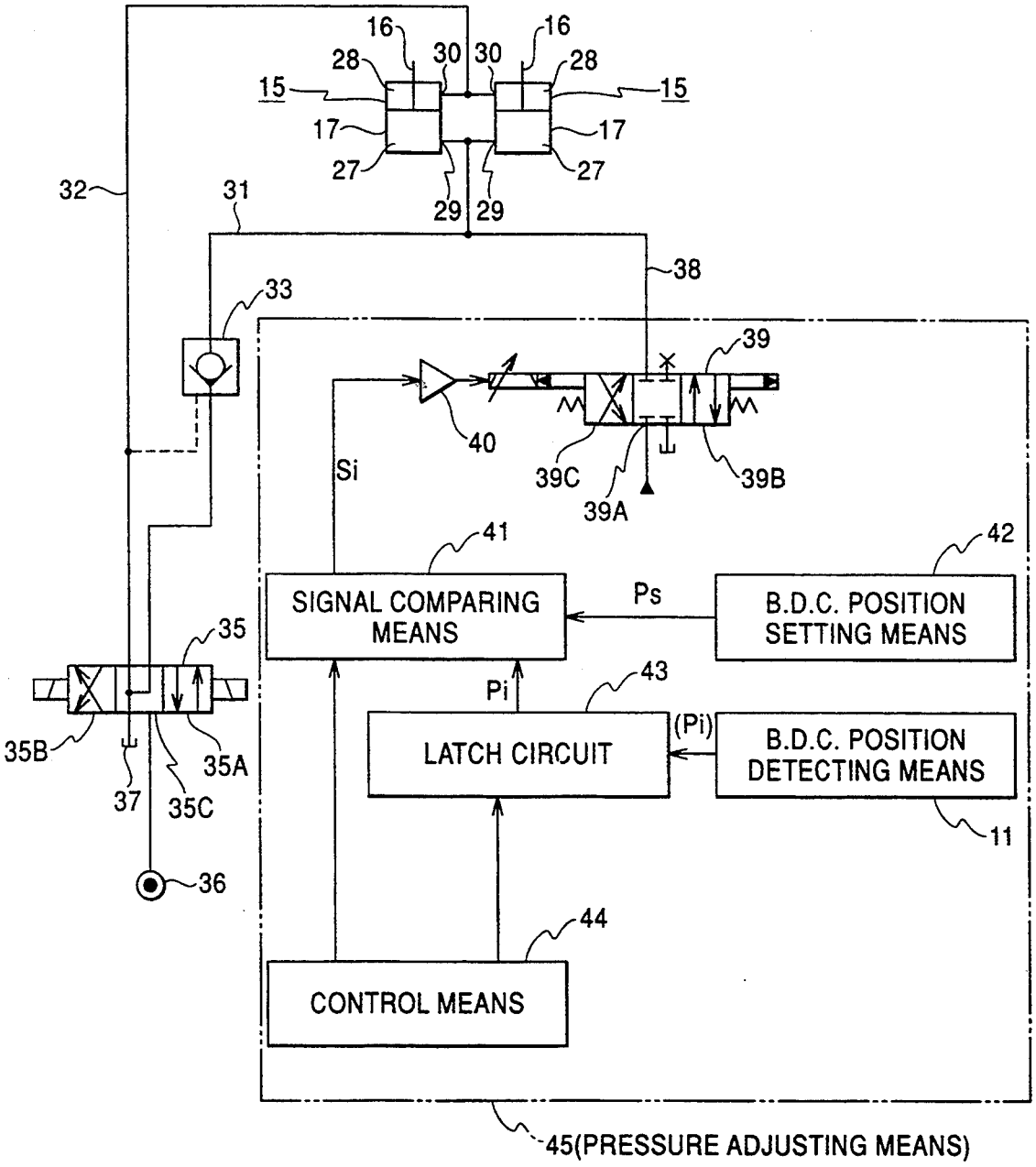
FIG. 3 is a circuit diagram for supplying pressure oil to a hydraulic cylinder shown in FIG. 2, and illustrates a pressure adjusting means.

A hydraulic chamber 27 is disposed in the cylinder body 17 below the piston portion 16A of the piston rod 16, while a hydraulic chamber 28 is disposed in the cylinder body 17 above the hydraulic chamber 27. Ports 29 and 30, which are supply and discharge ports of pressure oil and communicate with these hydraulic chambers 27 and 28, are provided in side wall portions of the cylinder body 17. A hydraulic circuit connected to these ports 29 and 30 is shown in FIG. 3. Terminating ends of hydraulic lines 31 and 32 are connected to the ports 29 and 30, a pilot-operated check valve 33 and a selector valve 35 are provided midway in these hydraulic lines 31 and 32. A pressure-oil supplying source 36 and an oil tank 37 are connected to starting ends of the hydraulic lines 31 and 32.

Also, a hydraulic line 38 is connected to the hydraulic line 31. A pressure control valve 39 is provided midway between the pressure-oil supplying source and this hydraulic line 38 so that the pressure-oil from the pressure-oil supplying source is supplied to the hydraulic chamber 27. The pressure control valve 39 is adapted to be changed over and controlled in response to a signal from a servo driver 40. A signal comparing means 41 is connected to the servo driver 40. A bottom-dead-center position setting means 42 and the bottom-dead-center position detecting means 11 shown in FIG. 1 are connected to the signal comparing means 41. A latch circuit 43 is provided between the signal comparing means 41 and the bottom-dead-center position detecting means 11. A control means 44 is connected to the signal comparing means 41 and the latch circuit 43.

A pressure adjusting means 45 is comprised of the above-described pressure control valve 39, servo driver 40, signal comparing means 41, bottom-dead-center position setting means 42, bottom-dead-center position detecting means 11, latch circuit 43, and control means 44, and controls the hydraulic pressure within the hydraulic chamber 27 in the hydraulic cylinder 15.

If the selector valve 35 is changed over from a position 35C to a position 35A, pressure oil is supplied to the hydraulic chamber 27. The pressure oil is discharged from the hydraulic chamber 28. Consequently, the piston rod 16 is raised to cause the hydraulic cylinder 15 to undergo extending motion. At the same time, the extending member 19 undergoes a displacement by being extended due to the hydraulic pressure acting on the piston 16A, thereby making preparations for press working a material.

In addition, the die height adjustment, which is used for replacement of the dies, is effected as follows: After the hydraulic pressure within the hydraulic chamber 27 is lowered by changing over the selector valve 35 to the position 35C and by changing over the pressure control valve 39 from a position 39A to a position 39C, the pinion 23 is rotated by the rotating member 24 to rotate the externally threaded member 26 with respect to the internally threaded member 20. Thus, the die height can be adjusted by raising the cylinder body 17 (through the contracting motion of the hydraulic cylinder 15) with respect to the piston rod 16 by means of the extending member 19 or by lowering the cylinder body 17 (through the extending motion of the hydraulic cylinder 15) with respect to the piston rod 16.

After the die height adjustment, the selector valve 35 is changed over from the position 35C to the position 35A, and the pressure control valve 39 is changed over to a position 39B, thereby supplying the pressure oil to the hydraulic chamber 27. As a result, the pressure of the pressure oil acts on the externally threaded member 26 by means of the piston 16A, the piston rod 16 and the extending member 19, so that the occurrence of the looseness of the externally threaded member 26 with respect to the internally threaded member 20 is prevented, and an adjustment screw using the threaded members 20 and 26 is set in a locked state.

Meanwhile, if the selector valve 35 is changed over to a position 35B, the pressure oil supplied to the second hydraulic chamber 28 exerts pressure upon the lower surface of the flange 26C of the externally threaded member 26, which is in a state of being connected to the cylinder body 17 by means of the internally threaded member 20, and upon the upper surface of the flange 19B of the extending member 19. At the same time, since the pressure oil is discharged from the hydraulic chamber 27, the cylinder body 17 rises with respect to the piston rod 16. As a result, the slide 5 can be raised without rotating the crank shaft 3 shown in FIG. 1, and the clearance between the upper die 6 and the lower die 9 can be enlarged, so that the die adjustment operation can be effected. For this reason, in this embodiment, the hydraulic cylinder 15 is also used as a cylinder of a quick die-opening mechanism which is used during the die adjustment operation.

A description will be given of the operation.

When press working is started by using new dies, the die adjustment operation is carried out by means of the aforementioned quick die-opening mechanism. Subsequently, a die height adjustment operation is performed by rotating the pinion 23 of the die height adjustment mechanism, and through this operation, the heightwise position of the slide 5 is set to be slightly higher than the height (die height) of the new dies at the time of press working. Subsequently, the bottom-dead-center position of the slide 5 is set to a predetermined bottom-dead-center position which is a position which accurately coincides with the die height of the new dies, by means of the bottom-dead-center position setting means 42 of the pressure adjusting means 45 shown in FIG. 3. When the slide 5 reaches the bottom-dead-center position by the rotation of the crank shaft 3, the heightwise position of the slide 5 at this time is detected by the bottom-dead-center position detecting means 11.

A signal Pi from the bottom-dead-center position detecting means 11 is sent to the latch circuit 43 where the data on the bottom-dead-center position of the slide is latched. When a pressure-adjustment-operation start signal from an unillustrated operation means is inputted to the control means 44, the control means 44 causes the signal Pi to be sent from the latch circuit 43 to the signal comparing means 41. The signal comparing means 41 compares the signal Pi with a signal Ps from the bottom-dead-center position setting means 42, and sends the result to the servo driver 40 as a signal Si. If the heightwise position of the slide 5 is higher than a set value of the bottom-dead-center position setting means 42, the servo driver 40 effects the changeover control of the pressure control valve 39 in accordance with a difference therebetween, so as to adjust the hydraulic pressure within the hydraulic chamber 27.

As a result, the hydraulic pressure within the hydraulic chamber 27 is raised to a pressure to be set, and a pressing load due to the hydraulic pressure acts on the piston portion 16A. As indicated by the dotted line A shown in FIG. 2, this pressing load is transmitted to the extending member 19, so that it undergoes a displacement by being extended. Consequently, the slide 5 moved downward. Since the pressure control valve 39 is subjected to change-over control such that the hydraulic pressure within the hydraulic chamber 27 corresponds to the difference between the signals Pi and Ps, the hydraulic pressure within the hydraulic chamber 27 is set to a predetermined pressure, so that the bottom-dead-center position of the slide is set to an accurate position set by the bottom-dead-center position setting means 42.

Figure 4:
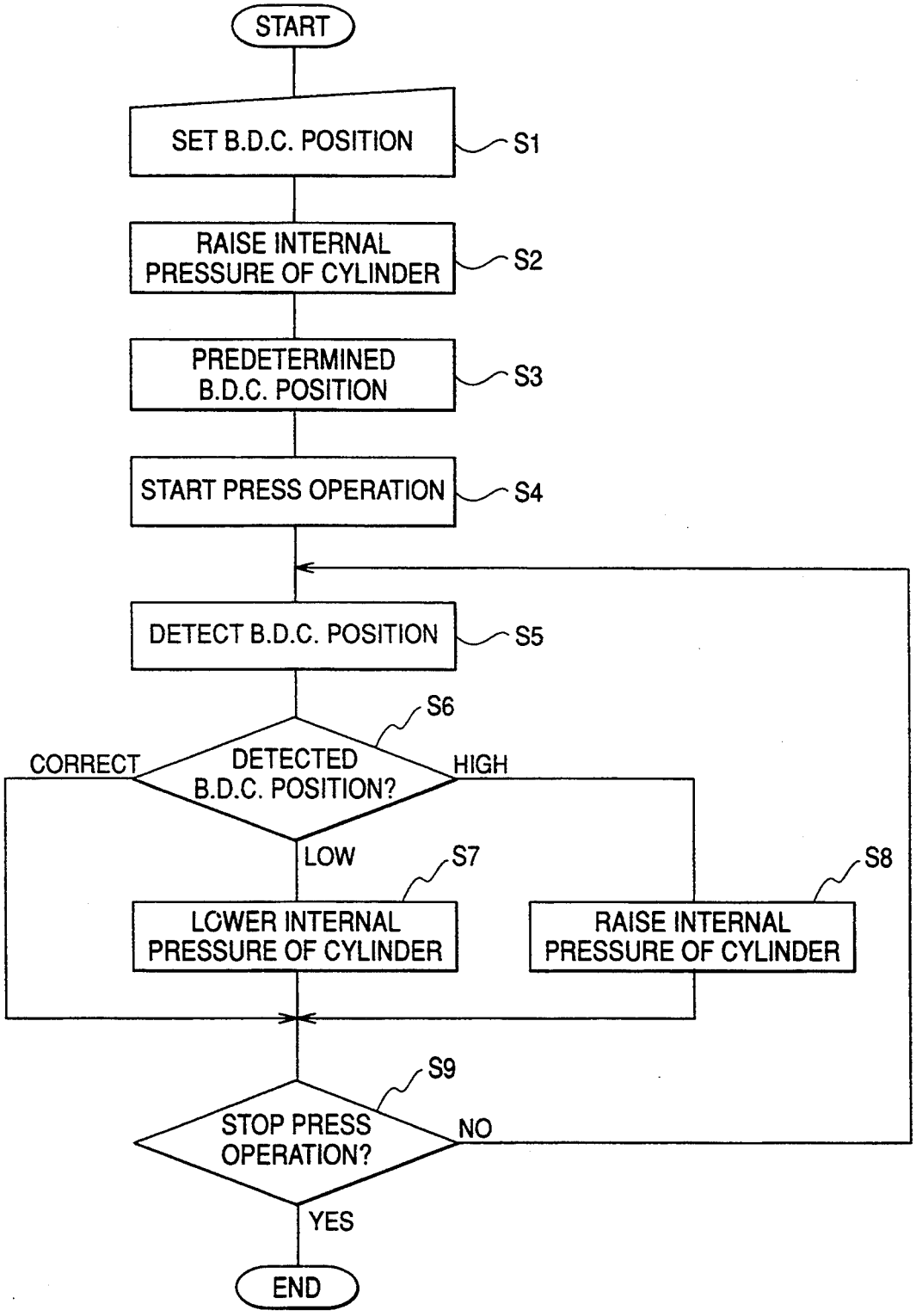
FIG. 4 is a flowchart illustrating an operation of adjusting the bottom-dead-center position of a slide.

The above-described operation is shown in the flowchart shown in FIG. 4 (refer to Steps S1 to S3). Referring to FIG. 4, a further description will be given of the operation for accurately maintaining the bottom-dead-center position of the slide during the press operation.

When the press operation is started (Step S4), the bottom-dead-center position in the vertical motion of the slide 5 per revolution during this press operation is detected by the bottom-dead-center position detecting means 11 (Step S5). The signal Pi representing the bottom-dead-center position of the slide detected per vertical motion of the slide 5 is latched by the latch circuit 43, and when the slide 5 reaches a predetermined position midway in the course of an upward-rising stroke from the bottom-dead-center position, a signal from a sensor for detecting the crank angle of the crank shaft 3 is inputted to the control means 44. The control means 44 causes the signal Pi to be inputted from the latch circuit 43 to the signal comparing means 41, and causes the signal comparing means 41 to compare the signal Ps from the bottom-dead-center position setting means 42 with the signal P1 (Step S6).

In this comparison, if the bottom-dead-center position of the slide is an accurate position as set by the bottom-dead-center position setting means 42, the pressure control valve 39 maintains the changeover position 39A. Meanwhile, after the starting of the press operation, in the event that the bottom-dead-center position of the slide has become offset downward from the accurate position as a result of the thermal expansion of the connecting rods and the like due to the continuous vertical movement of the slide 5, the servo driver 40 changes over the pressure control valve 39 from the position 39A to the position 39C in response to the signal from the signal comparing means 41 in correspondence with the difference between the signals Ps and Pi.

When the pressure control valve 39 is changed over to the position 39C, the hydraulic pressure within the hydraulic chamber 27 is lowered to a fixed pressure (Step S7). The pressing load acting on the cylinder body 17 is reduced, so that the tensile force acting on the extending member 19 becomes small, with the result that the amount of extension of the extending member 19 is reduced. Consequently, the bottom-dead-center position of the slide is raised, and is returned to its predetermined position.

Meanwhile, in Step S6, in the event that the bottom-dead-center position of the slide has been offset upward from the accurate position, the pressure control valve 39 is changed over from the position 39A to the position 39B in correspondence with the difference between the signals Pi and Ps by the servo driver 40 which received the signal from the signal comparing means 41, with the result that the hydraulic pressure within the hydraulic chamber 27 is raised to a fixed pressure (Step S8). Consequently, the bottom-dead-center position of the slide is lowered, and is returned to its predetermined position.

The above-described operation of adjusting the bottom-dead-center position of the slide is carried out each time the slide 5 undergoes one upward and downward motion, and this operation is continued until the press operation is stopped (Step S9). Then, when the next press operation is started after stopping the press operation and replacing the dies, the above operation starting with Step S1 is repeated.

In accordance with the above-described embodiment, it becomes possible to effect a press operation while obtaining an accurate bottom-dead-center position of the slide, with the result that the press load is also set to an appropriate value. The operation of adjusting the bottom-dead-center position of the slide can be carried out when the press is stopped or is being operated. It is unnecessary to stop the operation of the press for the purpose of this adjustment operation, so that the press operation can be conducted efficiently while maintaining the bottom-dead-center position of the slide at a predetermined position.

Furthermore, in accordance with this embodiment, the hydraulic cylinder 15 operates as a quick die-opening mechanism as well. In addition, since the externally threaded member 26, which constitutes a part of the die height adjustment mechanism, is fitted around the outer periphery of the extending member 19, the apparatus in accordance with this embodiment is also capable of effecting the die height adjustment operation.

Figure 5:
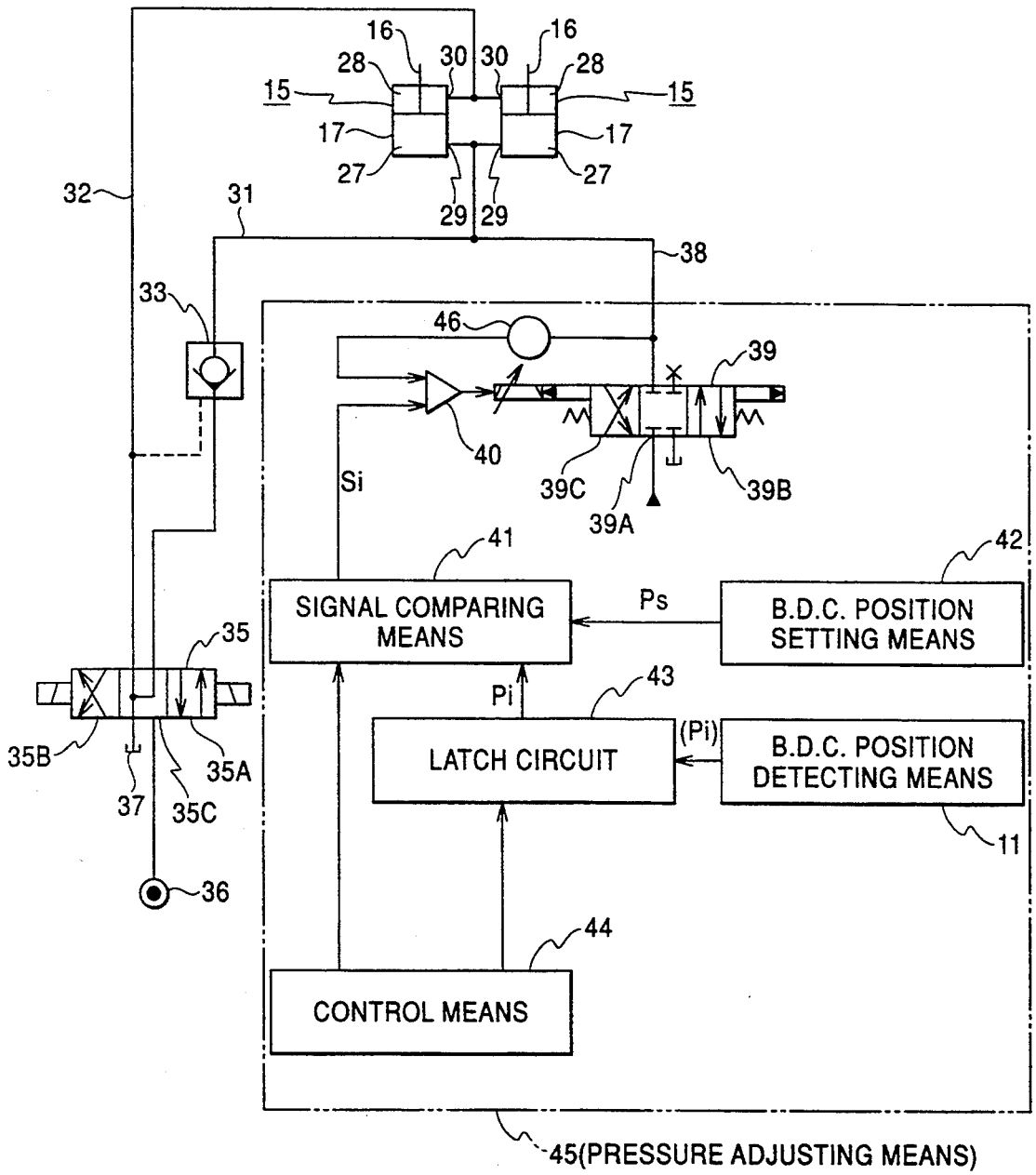
FIG. 5 is a circuit diagram similar to FIG. 3 and illustrates another example of the pressure adjusting means.

In the above-described construction, an arrangement may be provided such that, as shown in FIG. 5, a hydraulic pressure sensor 46 is connected to the hydraulic line 38 to make it possible to detect the magnitude of the hydraulic pressure constantly, and the servo driver 40 upon receipt of a signal from the hydraulic pressure sensor 46 changes over the pressure control valve 39 to the position 39A when it is detected by the hydraulic pressure sensor 46 that the magnitude of the hydraulic chamber 27 has reached a predetermined pressure (a pressure for obtaining a predetermined bottom-dead-center position of the slide) after the pressure control valve 39 is changed over from the position 39A to the position 39C or 39B. The aforementioned pressure adjusting means 45 includes such an arrangement as well.

In addition, the apparatus in accordance with the present invention is applicable to cases where the press load which changes due to a change in the bottom-deadcenter position of the slide during press working is adjusted. In that case, a press-load setting means is used instead of the bottom-dead-center position setting means 42, and a press-load detecting means is used instead of the bottom-dead-center position detecting means 11. This press-load detecting means is attached to the punch and the die, the slide, or the like.

Although the mechanical press in accordance with the above-described embodiment is of a type having two connecting rods 4, the apparatus in accordance with the present invention is also applicable to a mechanical press in which the number of the connecting rods is one or three or more.

Furthermore, although the hydraulic cylinder 15 is one for the quick die-opening mechanism, the apparatus in accordance with the present invention can also be arranged by replacing the same with, for instance, a hydraulic cylinder for a stick-disengagement mechanism or a hydraulic cylinder for an overload safety device, which is provided in a mechanical press. Furthermore, a hydraulic cylinder for exclusive use in the apparatus in accordance with the present invention, which does not include the quick die-opening mechanism, may be provided in the mechanical press.

As described above, in accordance with the present invention, it is possible to provide an apparatus for adjusting bottom-dead-center position of a slide in a mechanical press which offers unprecedentedly outstanding advantages in that the accurate operation of adjusting the bottom-dead-center position of the slide can be effected without unlocking the adjustment screw, and that this operation can be performed not only when the press is being stopped but also when the press is being operated, thereby making it possible to attain high-accuracy processing.

What is claimed is:

1. An apparatus for adjusting bottom-dead-center position of a slide in mechanical press including a connecting rod connected to a crank shaft, and a slide connected to said connecting rod by means of a hydraulic cylinder, wherein:

said hydraulic cylinder has a piston rod one end of which is connected to said connecting rod by means of a plunger, a cylinder body connected to said slide and provided in such a manner as to be movable relative to said piston rod, and a hydraulic chamber provided below said piston rod, pressure oil adjusted by means of a pressure adjusting means capable of being supplied to and discharged from said hydraulic chamber; and an extending member having one end connected to said connecting rod by means of said plunger and another end connected to said cylinder body is fitted around an outer periphery of said piston rod, said extending member being provided in such a manner as to be capable of being extended by the adjustment of hydraulic pressure within said hydraulic chamber.

2. The apparatus according to claim 1, wherein a bottom-dead-center position of said slide is corrected by adjusting the hydraulic pressure within said hydraulic chamber by means of said pressure adjusting means.

3. The apparatus according to claim 1, wherein said pressure adjusting means includes a pressure adjusting valve connected to said hydraulic chamber and a bottom-dead-center position detecting means provided in a vicinity of said slide and is provided in such a manner as to be capable of outputting a value of a detected bottom-dead-center position each time said slide undergoes upward and downward motion, and wherein said pressure adjusting valve maintains the accuracy of the bottom-dead-center position of said slide as said pressure adjusting valve is changed over on the basis of a difference between the output value of said bottom-dead-center position detecting means and a predetermined set value.

* * * * *